US010977964B1

(12) United States Patent
Le

(10) Patent No.: US 10,977,964 B1
(45) Date of Patent: Apr. 13, 2021

(54) LABEL HOLDER

(71) Applicant: BBY Solutions, Inc., Richfield, MN (US)

(72) Inventor: Adam Le, Shakopee, MN (US)

(73) Assignee: BBY Solutions, Inc., Richfield, MN (US)

( * ) Notice: Subject to any disclaimer, the term of this patent is extended or adjusted under 35 U.S.C. 154(b) by 0 days.

(21) Appl. No.: 16/834,073

(22) Filed: Mar. 30, 2020

(51) Int. Cl.

| | |
|---|---|
| ***G09F 3/18*** | (2006.01) |
| ***G09F 3/20*** | (2006.01) |
| ***G09F 3/10*** | (2006.01) |
| ***G09F 7/12*** | (2006.01) |
| *G09F 7/18* | (2006.01) |
| *A47G 1/06* | (2006.01) |

(52) U.S. Cl.
CPC ..... *G09F 3/208* (2013.01); *G09F 3/10* (2013.01); *G09F 7/12* (2013.01); *A47G 1/065* (2013.01); *G09F 7/18* (2013.01)

(58) Field of Classification Search
CPC ... G09F 3/208; G09F 3/10; G09F 7/12; G09F 15/04; G09F 13/04; G09F 7/18; F16B 47/00
See application file for complete search history.

(56) References Cited

U.S. PATENT DOCUMENTS

| | | | | |
|---|---|---|---|---|
| 5,075,991 | A * | 12/1991 | Wenkman | A47G 1/06 40/781 |
| 6,338,215 | B1 * | 1/2002 | Vincent | A47G 1/065 40/729 |
| 6,735,896 | B1 * | 5/2004 | Zager | A47G 1/17 40/611.02 |
| 7,584,562 | B2 * | 9/2009 | Youn | G09F 9/33 40/544 |
| 2012/0314353 | A1 * | 12/2012 | Williams | G09F 7/18 361/679.01 |
| 2016/0309926 | A1 * | 10/2016 | Jhagroo | A47G 1/065 |

* cited by examiner

*Primary Examiner* — Cassandra Davis
(74) *Attorney, Agent, or Firm* — Forsgren Fisher et al.; James M. Urzedowski; Daniel A. Tysver

(57) ABSTRACT

A system for displaying electronic shelf labels (ESLs) or other devices includes a label holder. The label holder includes a base plate, adhesive, suction cups, and dowels. The base plate has two opposing side upon which an ESL may be adhesively engaged and supported. When supporting a single ESL on only one side of the base plate, the opposite side of the base plate may be equipped with suction cups or front facing dowels with which the label holder may be attached to a surface. When supporting ESLs on both sides of the base plate, dowels may be inserted along perimeter surfaces of the base plate in order to allow the holder to be secured into or onto surfaces having openings capable of receiving the exposed ends of the dowels, such as those constructed of pegboard, etc.

15 Claims, 7 Drawing Sheets

LABEL HOLDER

FIELD OF THE INVENTION

Embodiments disclosed herein relate to a label holder for attaching and displaying labels, fact tags, display monitors, or other informational displays including Electronic Shelf Labels (ESLs) in a commercial setting.

BACKGROUND OF THE INVENTION

From retail store to wholesale warehouses, and other commercial settings, the products available therein as well as the displays of those products are in a seemingly constant state of change. As a consequence, many commercial entities have moved to the use of electronic shelf labels (ESLs) that have easily reprogrammable informational displays that allow a seller to change the information displayed to potential customers in a more fluid manner than conventional labels. ESLs may be provided in a variety of shapes and sizes, and may be programmed to display anything from basic product information akin to a more conventional label (e.g. price, quantity, etc.) to full audio/visual commercial programing, depending on their level of complexity.

In modern commercial environments the use of ESLs is sometimes made more difficult as the products themselves (and/or their packaging), the shelving they are displayed upon, and the commonly used hardware of a commercial environment are often not provided with mounting surfaces that accommodate ready acceptance or mounting of an ESL directly thereupon. To overcome this difficulty, various specialized ESL holders and mounting devices have been proposed, such as those described in U.S. Pat. Nos. 10,593,236 and 6,935,062, which are intended to improve the use of ESL in specific commercial instances.

While known ESL holders, such those in the examples provided above, may provide mechanisms for securing ESLs to specific surfaces common to a retail or wholesale setting (e.g. directly to a product package or to the C-channel of a retail shelf) there remains a need for an ESL display system that is compact, provides the ability to display one or more ESLs in a variety of orientations, and that is useable with in a wide range of commercial settings. The label holder disclosed herein meets this need.

SUMMARY OF THE INVENTION

Embodiments disclosed herein are directed to a label holder comprised of a substantially planar or "flat" base plate to which one or two ESLs or other type of labels or displays may be adhesively or mechanically engaged thereto. The base plate may be provided with dowels that allow the holder (and accompanying ESL(s)) to be mounted to a variety of commonly used commercial surfaces such as shelving and partition surfaces, and in a variety of orientations. The base plate may likewise be provided with suction cups or other engagement devices to allows the holder and a single ESL or display to be secured to a variety of flat surfaces. The label holder may be used with a large variety of ESL sizes and shapes and may even be used to display conventional static labels of paper and/or plastic.

Henceforth, as used herein the term "Electronic Shelf Label" or ESL, will refer to any type of electronic device having an output mechanism for visually and/or audibly displaying information.

DETAILED DESCRIPTION

Figure 7:
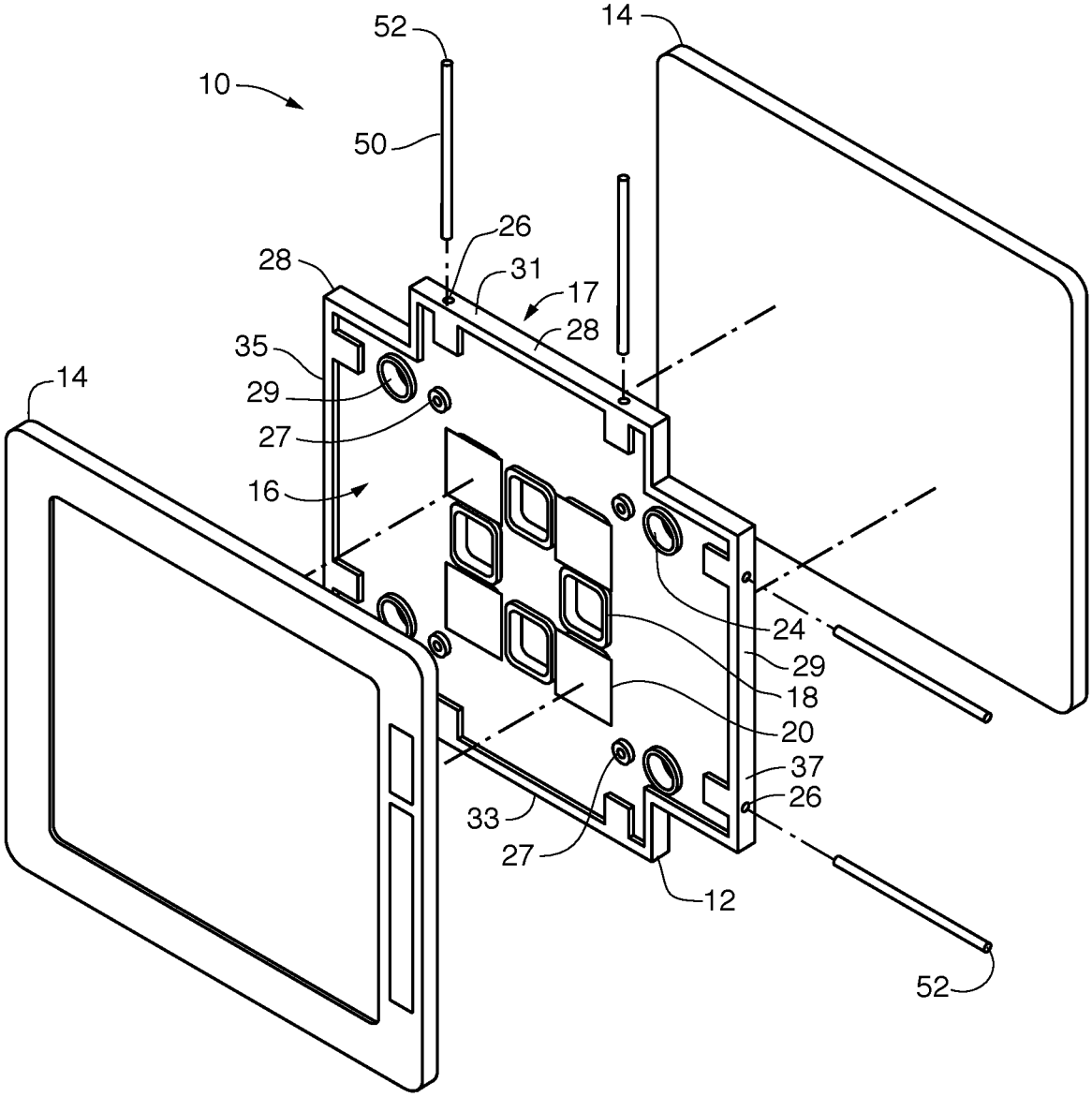
FIG. 7 is an exploded perspective view of the label holder base plate and dowels of FIGS. 5 and 6 but wherein the label holder is utilized to support a pair of ESLs.
Figure 8:
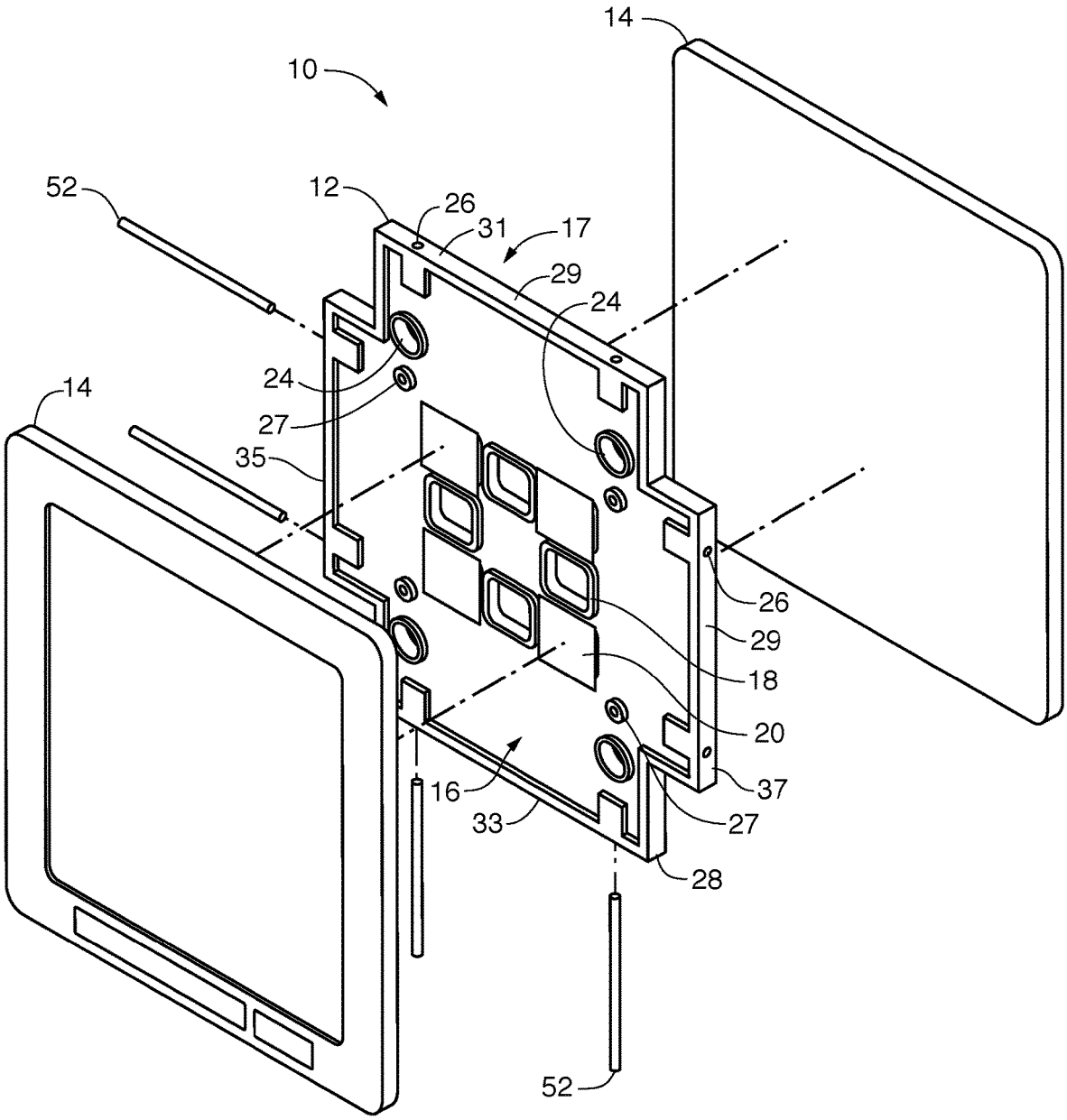
FIG. 8 shows the label holder and ESLs of FIG. 7 wherein the ESLs are depicted in a vertical orientation.

The label holder 10, as shown in FIGS. 1-9, is comprised of a base plate 12, that may be configured to support and display a single ESL 14 on a first side 16 of the base plate 12, such as in the embodiments shown in FIGS. 1 and 4-6; or two ESLs 14, with each ESL 14 attached to opposing sides 16 and 17 of the base plate 12, such as is in the manner shown in FIGS. 7-8. The base plate 12 may be attached to various surfaces using suction cups 40, or dowels 50 to provide for a display holder 10 that may be used to display ESLs in a variety of positions and orientations within a commercial setting such as in the examples shown in FIGS. 3 and 9.

As is shown in FIGS. 1, 2 and 4-8, the base plate 12 is equipped with a plurality of adhesive reception areas 18, wherein double-sided adhesive tape 20 or other types of adhesive material may be deposited or positioned in order to adhere an ESL 14 against the first side 16 of the base plate 12, and as specifically shown in FIGS. 7-8, the second side 17 of the base plate as well.

In the embodiments shown, there are eight adhesive reception areas 18 present on the base plate 12, of which four are shown with adhesive tape 20. Any number or pattern of the adhesive reception areas 18 may be provided with adhesive tape 20. according to the surface and weight requirements of the ESL 14 being adhered to the base plate 12, and the desire of the user. Likewise, embodiments of the base plate 12 may be provided with any number, size, shape and distribution of adhesive reception areas 18 depending on the size and configuration of the ESL(s) being used with the label holder 10. The pattern of adhesive reception areas 18 provided on one surface 16 is the same as on the other surface 17.

In some embodiments, one or more of the adhesive reception areas 18 may have a shape adapted to engage a corresponding surface shape on the ESL to allow the base plate 12 to mechanically engage the ESL 14 rather than or in addition to the adhesive engagement described above.

The base plate 12 may be constructed from any of a variety of materials having suitable structural rigidity to support one or more ESL displays. Such materials may include metal, plastics, or even wood based material. In a preferred embodiment, the base plate is an injection molded part made of Acrylonitrile Butadiene Styrene (ABS) plastic.

As to the size and shape the base plate 12, the base plate 12 may be of any size or shape but ideally should be no larger than the visible face 22 of an ESL 14 that it is to support.

Figure 2:
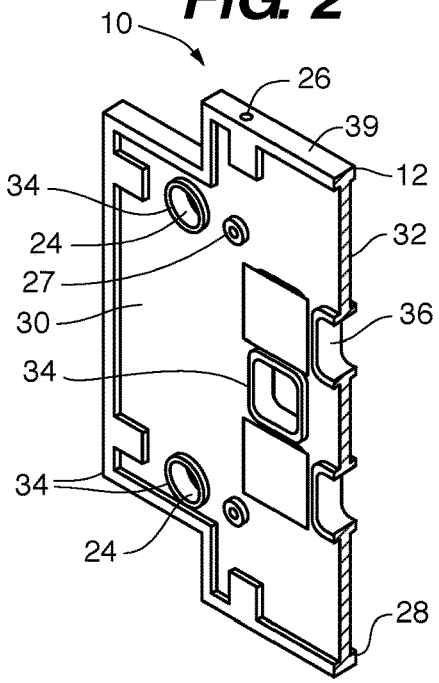
FIG. 2 is a partial sectional view of the base plate shown in FIG. 1.

As may best be seen in FIG. 2, the base plate 12 has a first region 30 of a substantially uniform first thickness 32 and a second region (or more accurately regions) 34, having a substantially uniform second thickness 36 that is greater than the first thickness 32. In at least one embodiment, the first thickness 32 is ⅓ of the second thickness 36. In at least one embodiment, the first thickness 32 measures 0.0625" and the second thickness 36 is 0.188" thick.

As is shown in FIGS. 1, 2, and 4-8, second regions 34 or regions of greater thickness 36 include those portions of the base plate 12 that define the adhesive reception areas 18, suction cup channels 24 and dowel channels 26. In the embodiments shown, the base plate 12 includes a perimeter ridge 28 of second thickness 36. Each of the four longest perimeter surfaces 29 define a pair if dowel channels 26. In some embodiments the number of dowel channels on the long surfaces 29 is between 2 and at least 6. In at least one embodiment the dowel channels 26 are approximately 3/32 of an inch (0.0938") in diameter. In at least one embodiment the depth of each of the dowel channels 26 is approximately ¼ of an inch (0.25").

As mentioned, above the perimeter ridge 28 of the base plate 12 has four perimeter surfaces 29 that are longer than the remaining perimeter surfaces. It should be noted that the cross-like or plus sign shape of the embodiment shown is merely one example of a potential shape that the base plate 12 may be provided with. Given that the majority of labels, or ESLs are rectangular in shape the base plate 12 may also be of a similar shape, but for purposes of minimizing the material needed to produce the base plate 12, the plate may be formed into any shape (such as the present cross shaped embodiment), as long as the resulting base plate 12 has sufficient area to support the ESL 14 on its front and back sides 16 and 17 (i.e. there is sufficient area to apply adhesive in a quantity sufficient to adhere an ESL to the faces 16 and 17 of the base plate 12), and to provide opposing outermost surfaces (surfaces 31 and 33 as well as 35 and 37) of the perimeter a length sufficient to contain at least two dowel channels 26.

Figure 9:
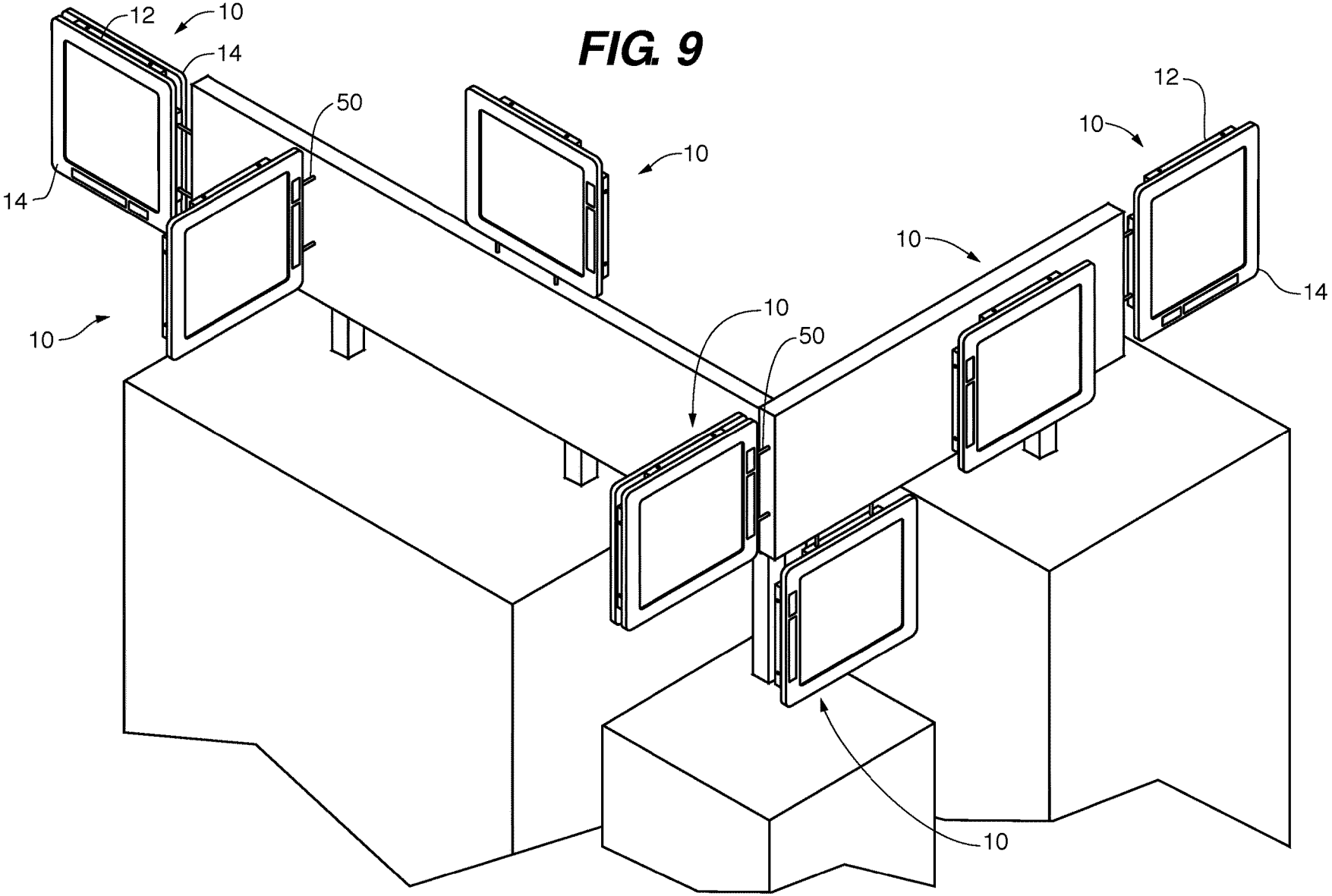
FIG. 9 is a partial perspective view of the assembled label holders and ESLs of FIGS. 4-8 shown in a potential environment of use.

The dowels 50 that may be removeably received into the dowel channels 26 (e.g. by frictional engagement) may be of any construction including wood, metal, plastic or any combinations thereof. The dowels 50 may be of any length, but in at least one embodiment they ¾ of an inch (0.75") in total length, of which ¼ of an inch (0.25") is configured to be received into the dowel channel 26. When engaged within a dowel channel 26, the exposed end 52 of a dowel 50 may be received into openings positioned on a variety of surfaces that have a corresponding spacing to that of at least two the dowel channels 26 on a side 29 of the base plate perimeter, in order to allow the ESL equipped holder 10 to be affixed to the surface in a wide variety of orientations, such as are illustrated in FIG. 9.

Figure 1:
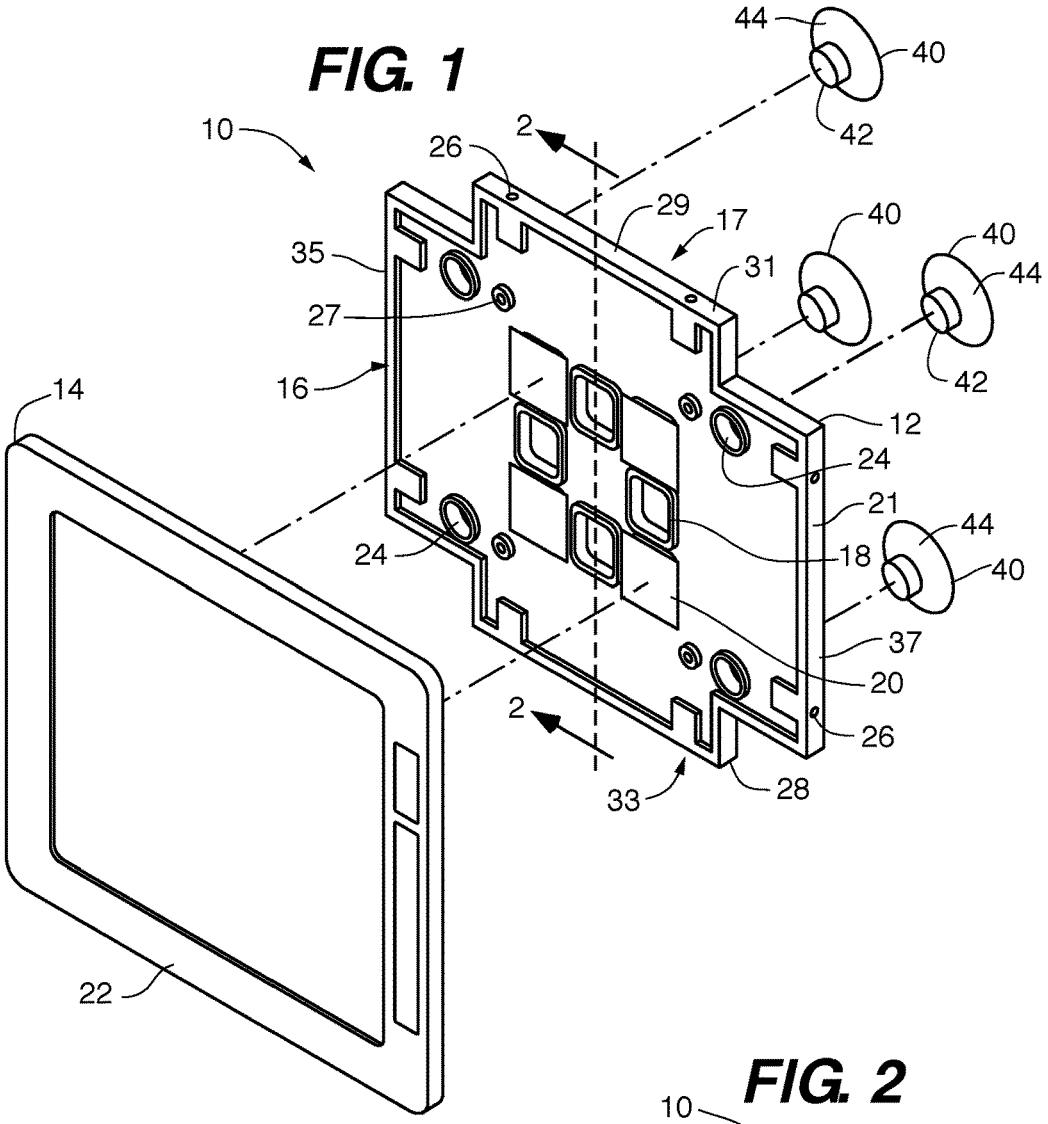
FIG. 1 is an exploded perspective view of an embodiment of a label holder base plate equipped with suction cups and an ESL.
Figure 3:
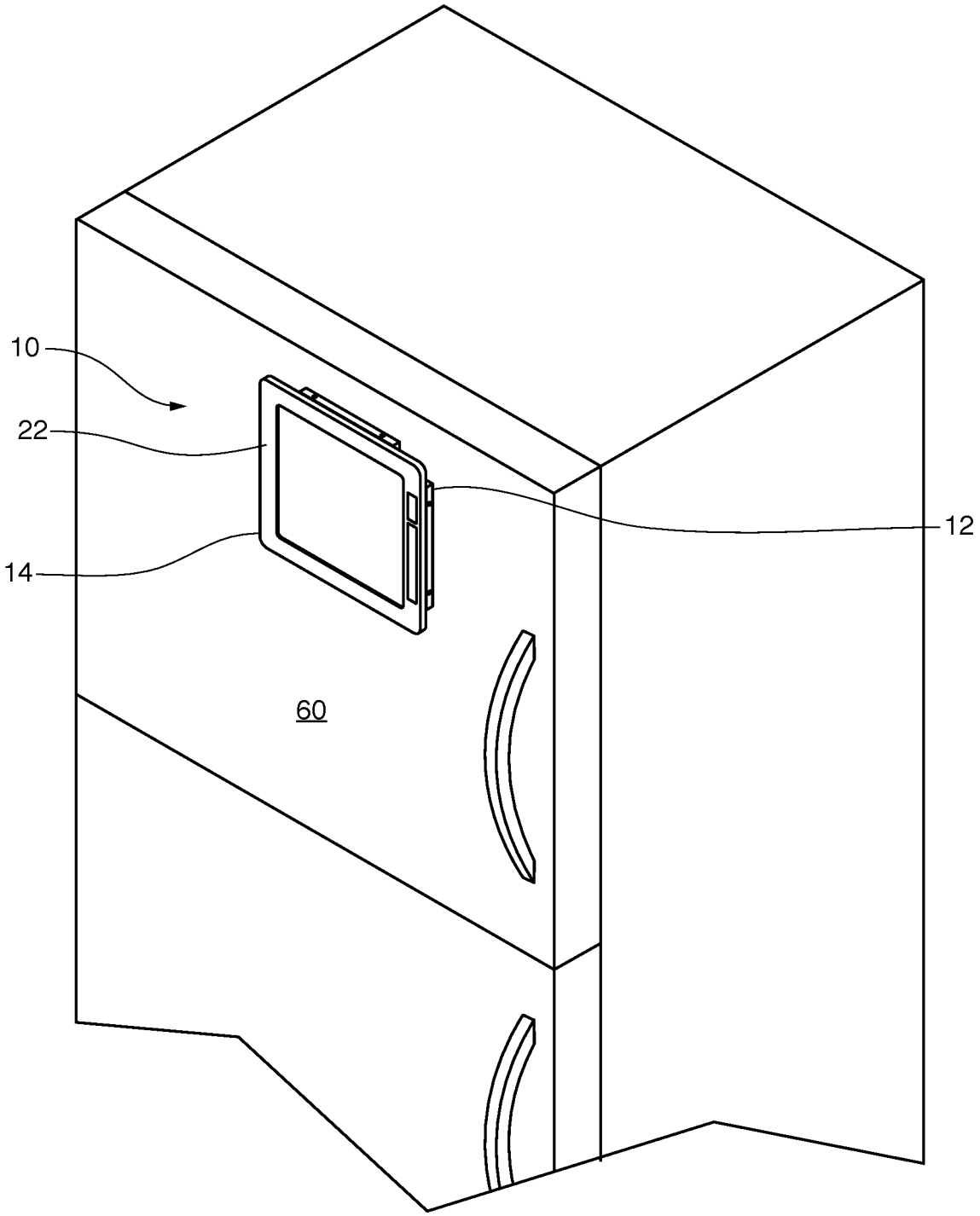
FIG. 3 is a partial perspective view of the assembled label holder and ESL of FIG. 1 shown in a potential environment of use.

As shown in FIG. 1, when it is desired to display a single ESL 14 against a planar surface, such as for example, the face of an appliance 60 shown in FIG. 3, the base plate 12 may be provided with suction cups 40, of which each has a stem portion 42 sized to be removeably engaged by the base plate 12 via suction cup channels 24. The cup portion 44 of the suction cups will extend outward from the side 17 of the base plate 12, opposite the side 16 to which the ESL 14 is adhesively engaged. When base plate 12, ESL 14 and suction cups 40 are assembled, the ESL equipped holder 10 may be secured to a planar surface, such as that of an appliance, in the manner shown in FIG. 3. In some embodiments, the suction cups may be replaced magnets, secured to the base plate in the same manner as the suction cups shown.

In many commercial settings it is common to construct displays and shelving from pegboard or similar perforated paneling. Such materials have openings configured for the receipt of hooks, cleats, hangers, dowels, and other components common to commercial displays. As mentioned above, the holder 10 may be provided with dowels 50, which allows the ESL equipped holder 10 to be mounted in a variety of orientations to surfaces made of pegboard or similar materials such as is shown in FIG. 9. Where surfaces in the commercial environment lack holes into which the dowels 50 may be received, appropriate sized and spaced holes may be provided such as by drilling, etc.

Figure 4:
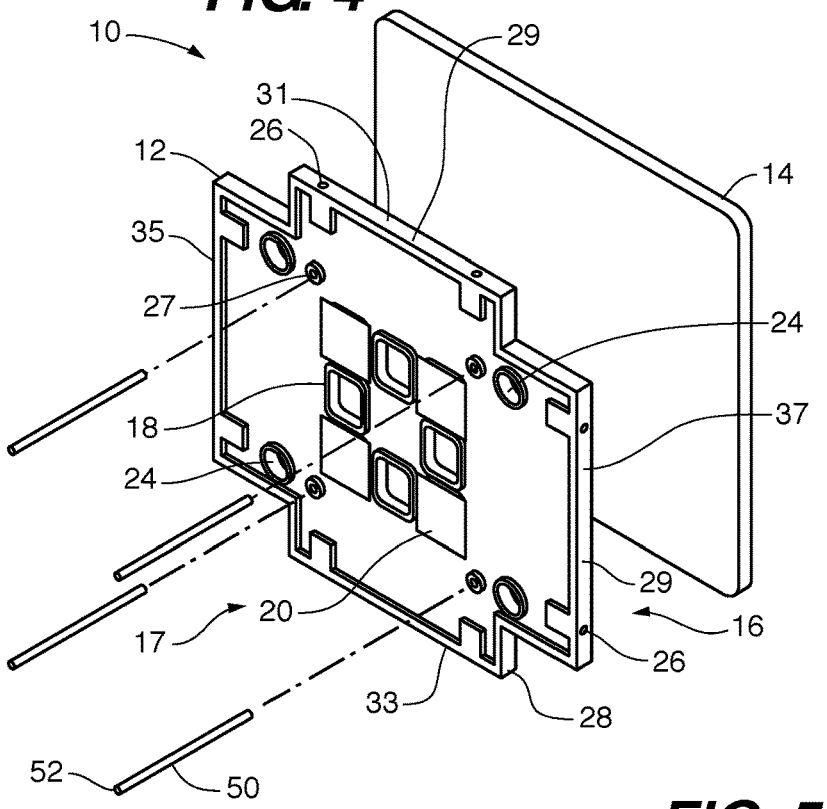
FIGS. 4-6 each show the label holder base plate and ESL of FIG. 1, with dowels and their potential positions of insertion into the base plate being depicted.
Figure 5:
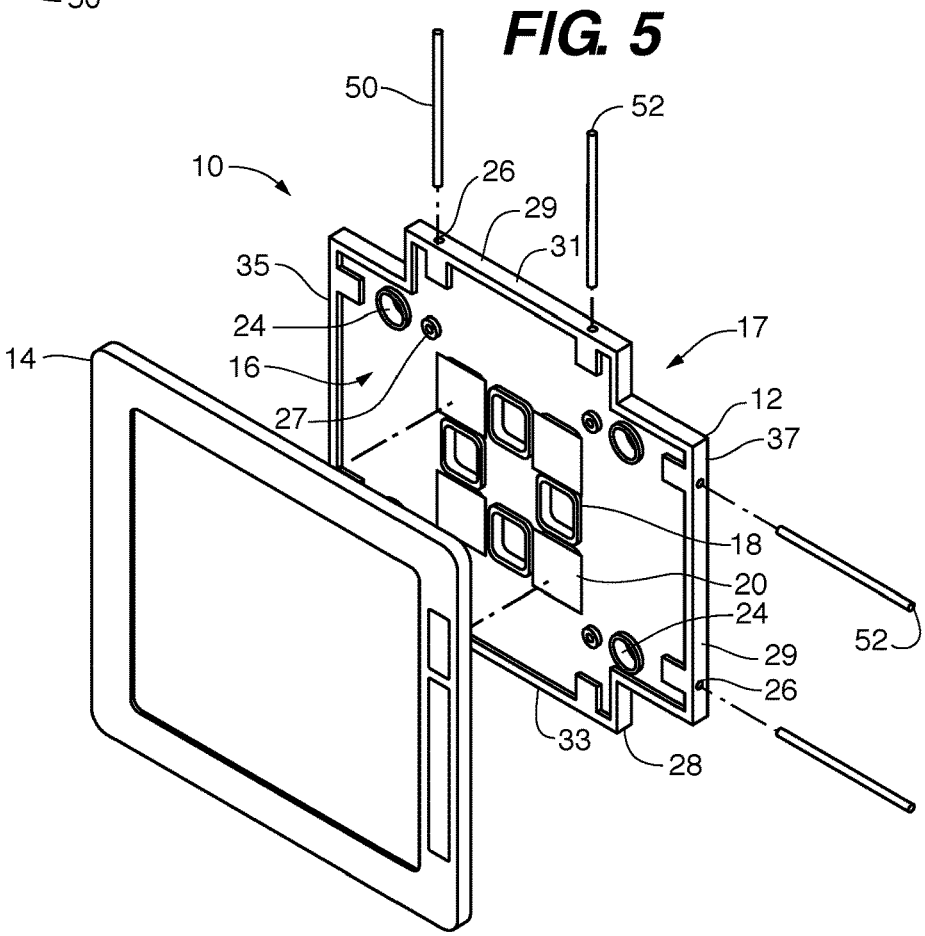
Figure 6:
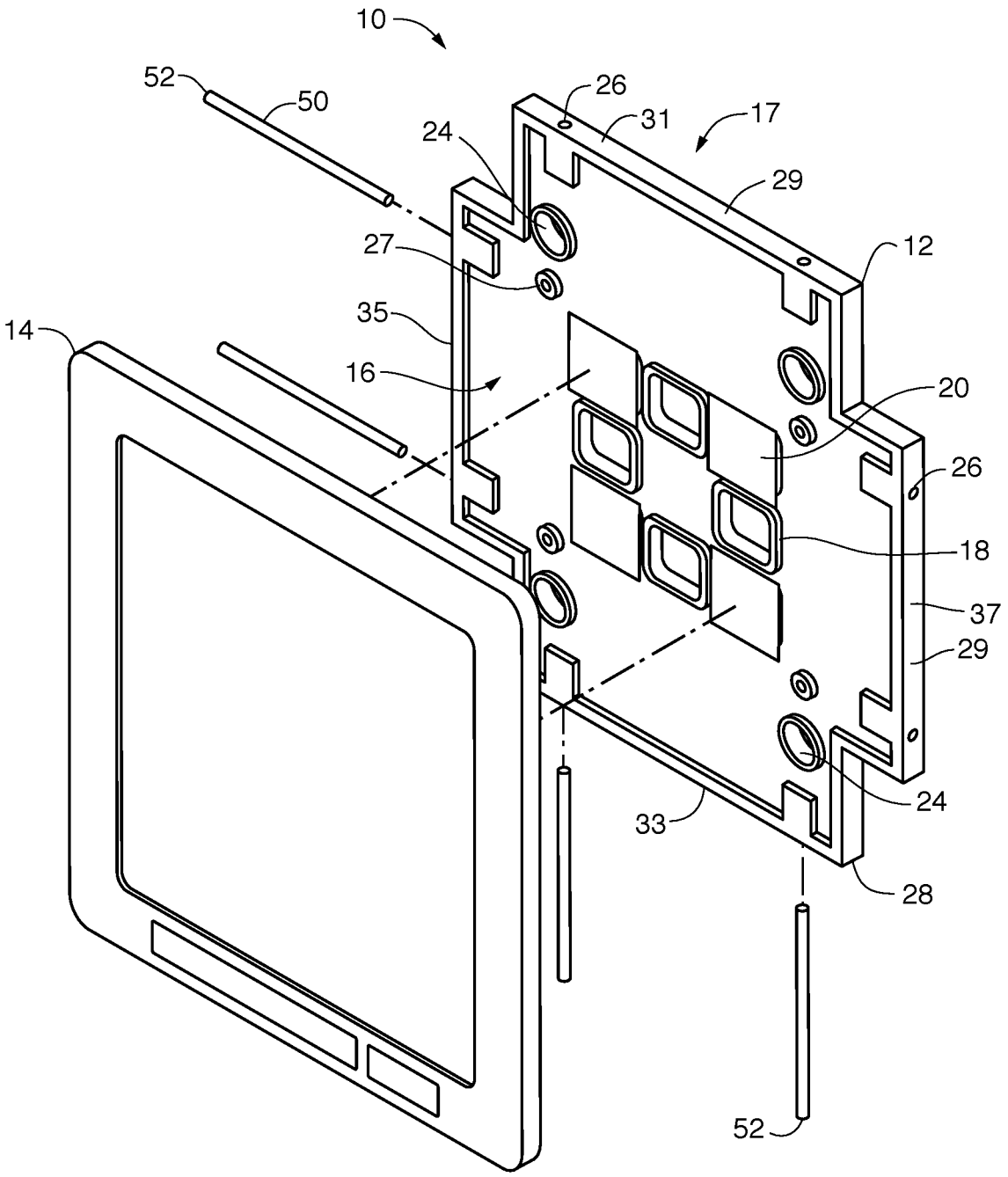

As discussed above, the base plate 12 has dowel openings or channels 26 positioned along, and defined by, the perimeter ridge 28. These dowel channels 26 may be characterized as perimeter based dowel openings 26 that provide channels into which a portion of a dowel 50 may be inserted and frictionally retained within. The base plate 12 also has a second type of dowel opening that may be characterized as front facing dowel channels 27. As is best shown in FIG. 4, these front facing dowel channels 27 comprise channels that extend through the thickness of the base plate 12 to allow a dowel 50 to be engaged therein from either side 16 or 17 of the base plate 12. These front facing dowel channels 27 are oriented or extend in a direction perpendicular to those of the perimeter based dowel channels 26, and are defined by regions of second thickness 36 (i.e. perimeter dowel channels 26 extend into the "plane" of the base plate 12, while front facing dowel channels 27 extend through the thickness of that plane). When an ESL 14 is adhered to one side 16 of the base plate 12, dowels 50 may be received by the front facing dowel channels 27, which then allows the holder 10, via the exposed ends 52 of the dowels 50, to be mounted to a vertical surface of a pegboard display, such as in the manner shown in FIG. 9.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A label holder comprising:

a base plate, the base plate having a first side and a second side opposite the first side, a first region having a first thickness and a second region having a second thickness, wherein the second thickness is greater than the first thickness, the second region defining a plurality of adhesive reception areas, the second region defining a plurality of suction cup channels, the second region defining a perimeter ridge, the perimeter ridge having four perimeter sides, each of the four perimeter sides defining at least two perimeter dowel channels, the second region defining a plurality of front facing dowel channels, the plurality of front facing dowel channels being oriented in a perpendicular direction to that of the perimeter dowel channels;

an adhesive;

a plurality of suction cups, each suction cup having a cup portion and a stem portion, the stem portion configured for removeable receipt into one of the plurality of suction cup channels; and a plurality of dowels, each dowel having a portion configured for removeable receipt into one of the perimeter dowel channels and front facing dowel channels.

2. The label holder of claim 1, wherein the first side of the base plate is configured to engage and support one Electronic Shelf Label (ESL) and the second side is configured to engage and support a second ESL.

3. The label holder of claim 2, wherein the adhesive is a double-sided adhesive tape.

4. The label holder of claim 3, wherein the double-sided adhesive tape is applied to at least some of the plurality of adhesive reception areas on at least one of the first side of the base plate and the second side of the base plate.

5. The label holder of claim 4, wherein the double-sided adhesive tape is applied to at least some of the plurality of adhesive reception areas on only the first side of the base plate.

6. The label holder of claim 5, wherein the stem portion of each of the plurality of suction cups are removeably received into one of the plurality of suction cup channels from the second side of the base plate.

7. The label holder of claim 5, wherein each of the front facing dowel channels is engaged by one of the plurality of dowels.

8. The label holder of claim 4, wherein each of the at least two perimeter dowel channels on one of the perimeter sides are engaged by one of the plurality of dowels.

9. The label holder of claim 1, the plurality of adhesive reception areas comprising at least four adhesive reception areas.

10. The label holder of claim 1, the plurality of adhesive reception areas comprising at least eight adhesive reception areas.

11. The label holder of claim 1, wherein the first thickness is ⅓ that of the second thickness.

12. The label holder of claim 1, wherein the first thickness is measures 0.0625 inches and the second thickness measures 0.188 inches.

13. The label holder of claim 1, wherein each of the perimeter dowel channels and each of the front facing dowel channels have a diameter of 0.0938 inches.

14. The label holder of claim 1, wherein each of the perimeter dowel channels have a depth of 0.25 inches.

15. A system for displaying Electronic Shelf Labels comprises at least one Electronic Shelf Label (ESL) and an ESL label holder, the holder comprises:

a base plate, the base plate having a first side and a second side opposite the first side, a first region having a first thickness and a second region having a second thickness, wherein the second thickness is greater than the first thickness, the second region defining a plurality of adhesive reception areas, the second region defining a plurality of suction cup channels, the second region defining a perimeter ridge, the perimeter ridge having four perimeter sides, each of the four perimeter sides defining at least two perimeter dowel channels, the second region defining a plurality of front facing dowel channels, the plurality of front facing dowel channels being oriented in a perpendicular direction to that of the perimeter dowel channels;

an adhesive;

a plurality of suction cups, each suction cup having a cup portion and a stem portion, the stem portion configured for removeable receipt into one of the plurality of suction cup channels; and a plurality of dowels, each dowel having a portion configured for removeable receipt into one of the perimeter dowel channels and front facing dowel channels;

the at least one ESL being adhesively engaged to at least one of the first side and second side of the base plate.

* * * * *